US005405050A

United States Patent [19]

Walsh

[11] Patent Number: 5,405,050

[45] Date of Patent: Apr. 11, 1995

[54] ELECTRIC DISPENSER

[75] Inventor: John T. Walsh, Duluth, Ga.

[73] Assignee: Nordson Corporation, Westlake, Ohio

[21] Appl. No.: 143,930

[22] Filed: Oct. 27, 1993

[51] Int. Cl.[6] ..... B67D 3/00

[52] U.S. Cl. ..... 222/1; 222/504; 335/234; 335/281

[58] Field of Search ..... 222/504, 1; 335/230, 335/279, 229, 234, 281; 251/129.01, 141, 285, 65

[56] References Cited

U.S. PATENT DOCUMENTS

| | | | |
|---|---|---|---|
| 3,162,336 | 12/1964 | Erickson | 222/504 X |
| 3,187,949 | 6/1965 | Mangel | 222/504 X |
| 3,343,721 | 9/1967 | Paley | 222/504 X |
| 3,408,008 | 10/1968 | Cocks . | |
| 3,485,417 | 12/1969 | Cocks . | |
| 3,811,601 | 5/1974 | Reighard et al. | 222/504 X |
| 3,817,431 | 6/1974 | Kempton | 222/504 X |
| 3,827,604 | 8/1974 | Hamilton et al. | 222/504 X |
| 3,848,755 | 11/1974 | Possell | 222/504 X |
| 4,437,488 | 3/1984 | Taggart et al. . | |
| 4,453,652 | 6/1984 | Merkel et al. . | |
| 4,524,802 | 6/1985 | Lawrence et al. | 222/504 X |
| 4,531,679 | 7/1985 | Pagdin . | |
| 4,653,720 | 3/1987 | Knapp et al. . | |
| 4,660,011 | 4/1967 | Reiter . | |
| 4,690,371 | 9/1987 | Bosley et al. . | |
| 4,779,838 | 10/1988 | Greiner et al. . | |
| 4,951,917 | 8/1990 | Faulkner . | |
| 4,962,871 | 10/1990 | Reeves | 222/504 |
| 4,981,280 | 1/1991 | Brandenberg . | |
| 4,981,281 | 1/1991 | Brundage et al. . | |
| 5,010,911 | 4/1991 | Grant . | |
| 5,022,629 | 6/1991 | Tibbals . | |

FOREIGN PATENT DOCUMENTS

| | | |
|---|---|---|
| 2207435 | 6/1974 | France . |
| 2641987 | 7/1990 | France . |

OTHER PUBLICATIONS

Reference Drawing, Gun Electric, E-700; Drawing No. 0010955.

Magnetic Circuits and Transformers; p. 95; Massachusetts Institute of Technology; By Members of the Staff of the *Department of Electrical Engineering.*

Plast-O-Matic Valves, Inc.; Digest Catalog 20; Apr. 1992; Quality Engineered Thermoplastic Valves & Controls.

Nordson ® E-700 Electric Gun, Nordson Corporation Jun. 1991, pp. 7-9, 7-10 & 7-11.

*Primary Examiner*—Andres Kashnikow
*Assistant Examiner*—Kenneth R. DeRosa
*Attorney, Agent, or Firm*—Raymond J. Slattery, III

[57] ABSTRACT

An apparatus for dispensing viscous fluids, such as adhesives, sealants, caulks is actuated by an electromagnetic coil assembly (42,136) in conjunction with a magnet (38,126) mounted to a plunger (26,118). Energizing the coil assembly produces an electromagnetic field which cooperates with the magnetic field to cause the plunger to open. Closing results from reversing the electromagnetic field.

25 Claims, 2 Drawing Sheets

ELECTRIC DISPENSER

DESCRIPTION OF THE INVENTION

This invention is directed to a fluid dispenser, such as for the dispensing of adhesives, sealants and caulks. More particularly, this invention is directed to an electromagnetically actuated fluid dispenser utilizing an electromagnetic field and a magnetic field generated by a permanent magnet for moving a plunger to open or close the dispenser.

It is common in the dispensing of adhesives to use a pneumatic actuated dispenser, whereby a supply of air is used to move a plunger in reciprocal movement, such that a shut-off needle connected to the plunger is moved from or moved to a seat to permit or stop the dispensing of a pressurized fluid adhesive. To overcome deficiencies of pneumatic dispensers, electromagnetic dispensers have been developed wherein a plunger is driven open by an electromagnetic field and closed by a spring biasing means.

Many of the existing electromagnetic dispensers are of such a large configuration that they do not lend themselves to be used in multiple configurations, such as mounting a plurality of dispensing side by side to form a bank of dispensers. In many applications, such as carton sealing, it is desirous to apply a plurality of beads to a substrate at fairly close intervals. Some existing pneumatic guns are of such a compact size that they are readily adaptable for mounting as a bank of dispensing guns. It is therefore desirous to produce an electromagnetic gun which is capable of operating at high speed on/off cycles which is of a compact design similar to the existing pneumatic guns, such as the Nordson® H200 manufactured by Nordson Corporation, for producing finely spaced beads of material.

Also, some existing designs of electromagnetic guns require dynamic seals. Dynamic seals are seals in which an object moves therethrough, such as a plunger, and is used to prevent fluid from migrating past the seal. Eventually, a dynamic seal will wear and lose its sealing properties. This may result in adhesive migrating into various portions of the dispensing gun wherein the adhesive may cause damage or the failure thereof. Therefore, it is also desirous to produce an electromagnetic gun which does not require the use of dynamic seals.

The power required to operate an electromagnetic gun is also important. The more power required will generate more heat due to the $I^2R$ loses. The more heat that is generated is not only a waste of power, but can cause the dispenser to fail prematurely.

As the magnitude of the current passing through the windings increases and/or the length of time the current passing through the windings increases, i.e., longer actuation (on cycle) with a shorter off cycle, more and more heat is generated, thus raising the temperature of the coil. If the heat generated causes the temperature to rise too high, the insulation of the coil may degrade and break down, which may eventually cause the dispenser to fail. This problem is compounded by the fact that in the dispensing of heated fluid materials, such as adhesives commonly known as hot melt adhesives, the fluid material itself may transfer additional heat to the coil. This additional heat contributes to an increase in the temperature of the coil, thus decreasing the allowable temperature rise that can be tolerated by the coil resulting from the current passing through the windings. As the application temperature of the adhesive increases, more heat is available to be transferred to the coil, thus decreasing the amount of heat that can be generated by the coil in order to avoid thermal breakdown. As such, the coil will not be able to generate as much energy to drive the plunger. This may result in the dispenser having to operate at cycle rates having short on times and longer off times in order to allow the coil to cool.

Since the application temperature of the fluid must be maintained, such as to maintain the viscosity of the adhesive at a particular level, heaters are generally provided. Typically cartridge type heaters are provided in the dispenser or the associated service block, thus adding another source which can potentially add heat to the coil.

Therefore, it is desirous to produce an electromagnetic dispenser which is efficient to operate and does not generate an excessive amount of heat.

SUMMARY OF THE INVENTION

It is an object of the invention to provide an improved electromagnetic dispenser.

It is also an object of the invention, according to one embodiment of the invention, to provide an electromagnetic dispenser which does not require dynamic seals. This may be accomplished, for example, by providing a moveable plunger which is located in a fluid bore or chamber in which the movement of the distal end of the plunger from the valve seat, does not extend beyond the fluid bore or chamber.

It is also an object of this invention, according to one embodiment, to produce a compact fluid dispenser.

It is also an object of this invention, according to one embodiment, to produce an electromagnetic dispenser which may be used in dispensing of heated polymeric materials.

It is also an object of the invention according to one embodiment, to provide a means for thermally insulating the means for generating the electromagnetic field from the heat transferred from the heated fluid.

It is also an object of this invention, according to one embodiment, to produce a dispenser having reduced power consumption. A force is required in order to drive the plunger open or closed. In order to open an electromagnetic dispenser which utilize a spring to bias the dispenser closed, a force must be generated which will not only move the plunger the given distance in a specified time, it also must overcome the force of the spring. The spring, therefore, only provides a cooperating force in one direction (closing) and not in the opening portion of the cycle. With this invention, a constant field may be provided by a magnet which co-operates with the field of the electromagnet in both the opening and the closing of the dispenser. The cooperation of the fields means that the magnet and the electromagnetic fields both aid in the movement of the plunger as opposed to canceling or diminishing one of the fields. In other words, the utilization of a spring biasing means produces a force opposite to the opening which must be overcome by the electromagnetic field. However, fields generated according to this invention work in conjunction with one another to generate the force required to move the plunger for either the opening or closing of the dispenser. This results in less amp-turns required to effectuate the movement of the plunger. As a result, less current, windings, or a combination of both are required for the coil of the dispenser.

Some of these and others objects, features and advantages can be accomplished by a dispenser having: a housing having a bore, coupled to an inlet for receiving the material, the bore having a discharge outlet for dispensing the material; a plunger slidably mounted in the bore for reciprocally moving from an open to a closed position, having a valve needle carried at a first end for mating with a seat in the closed position to prevent the discharge of the material from the discharge outlet and being spaced a predetermined distance therefrom in the opened position to permit the discharge of material from the discharge outlet; a magnet, carried at a second end of the plunger; an electromagnetic coil assembly, having a pole piece and a coil having a plurality of windings disposed around said pole piece, for generating an electromagnetic field; and wherein the interaction of the electromagnetic field and a magnetic field generated by said permanent magnet effects the slidable movement of the plunger from the opened to the closed position.

Some of these and other objects, features, and advantages may also be accomplished by an apparatus comprising a housing having a bore therein, the bore being coupled to an inlet for receiving material and to a discharge outlet for dispensing the material therefrom; a means, movably mounted within the bore including a mating means for mating with a seat in a closed position to prevent the discharge of material from the discharge outlet, and being spaced therefrom in an open position; a magnet for generating a magnetic field; and a means for generating electromagnetic fields of opposite polarity, a means for directing said magnetic field and one of said electromagnetic fields to cooperate with each other to effectuate the movement of the plunger from the open to the closed position or from the closed to the open position.

Some of these and other objects, features, and advantages may be also accomplished by the method of dispensing a polymeric material comprising the steps of directing the flow of the polymeric material through a bore containing a plunger slidably mounted therein, said plunger including a magnet for generating a magnetic field, generating an electromagnetic field, causing the generated electromagnetic field and the magnetic field to co-operate with one another to effectuate the movement of the plunger from a closed to an open position, and wherein the polymeric material is directed past said plunger and discharged from a discharge orifice.

DESCRIPTION OF THE DRAWINGS

The following is a brief description of the drawings in which like parts may bear like reference numerals and in which.

DEFINITION

The following definitions are applicable to this specification, including the claims, wherein;

"Axial" and "Axially" are used herein to refer to lines or directions that are parallel to the axis of reciprocal motion of the plunger of the dispenser.

"Cold materials" are materials which are liquid at normal ambient temperatures, such as those adhesives which are liquid at room or ambient temperature, as well as viscous materials other than adhesives, such as gasketing and/or caulking materials.

"Inner" means directions toward the axis of motion of the plunger and "Outer" means away from the axis of motion of the plunger.

Hot melt materials are those materials, such as adhesives, which are solid at room or ambient temperature but, when heated, are converted to a liquid state.

"Radial" and "Radially" are used to mean directions radially toward or away from the axis of motion of the plunger.

"Permanent Magnet" means a material that once it is magnetized, retains its magnetic field for a substantial period of time as opposed to the electromagnetic field which exists only while current is flowing.

DETAILED DESCRIPTION OF THE INVENTION

For the purpose of the present discussion, the method and apparatus of this invention are described in connection with the dispensing of a hot melt polymeric material used in adhesive applications. It should be understood that the methods and apparatus of this invention are equally applicable for use in connection with the mixing and dispensing of cold materials.

Figure 1:
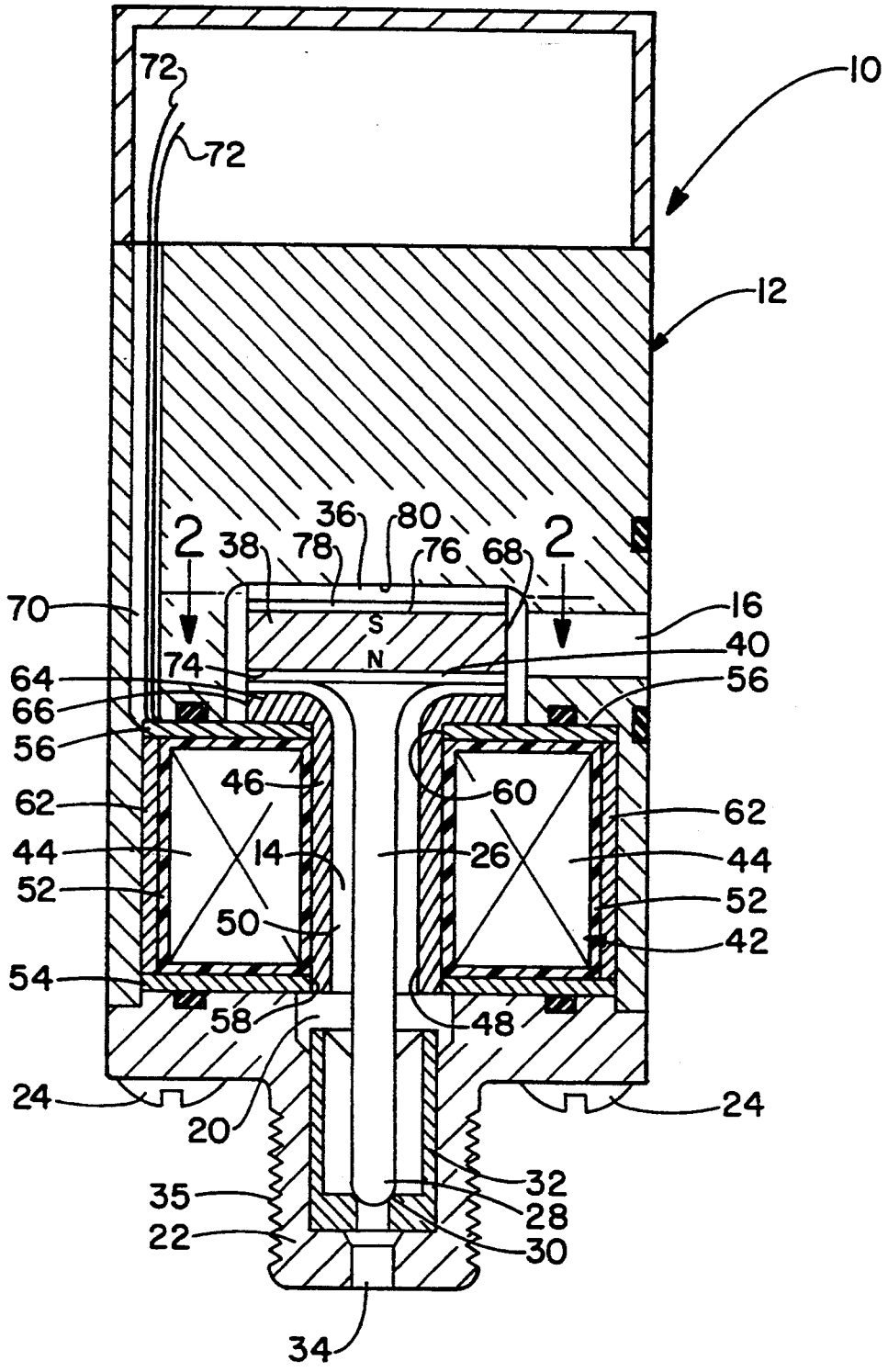
FIG. 1 is a cross-sectional elevational view of a dispenser made in accordance with one embodiment of this invention, and wherein the plunger of the dispenser is in the closed position.
Figures 2, 3, 4:
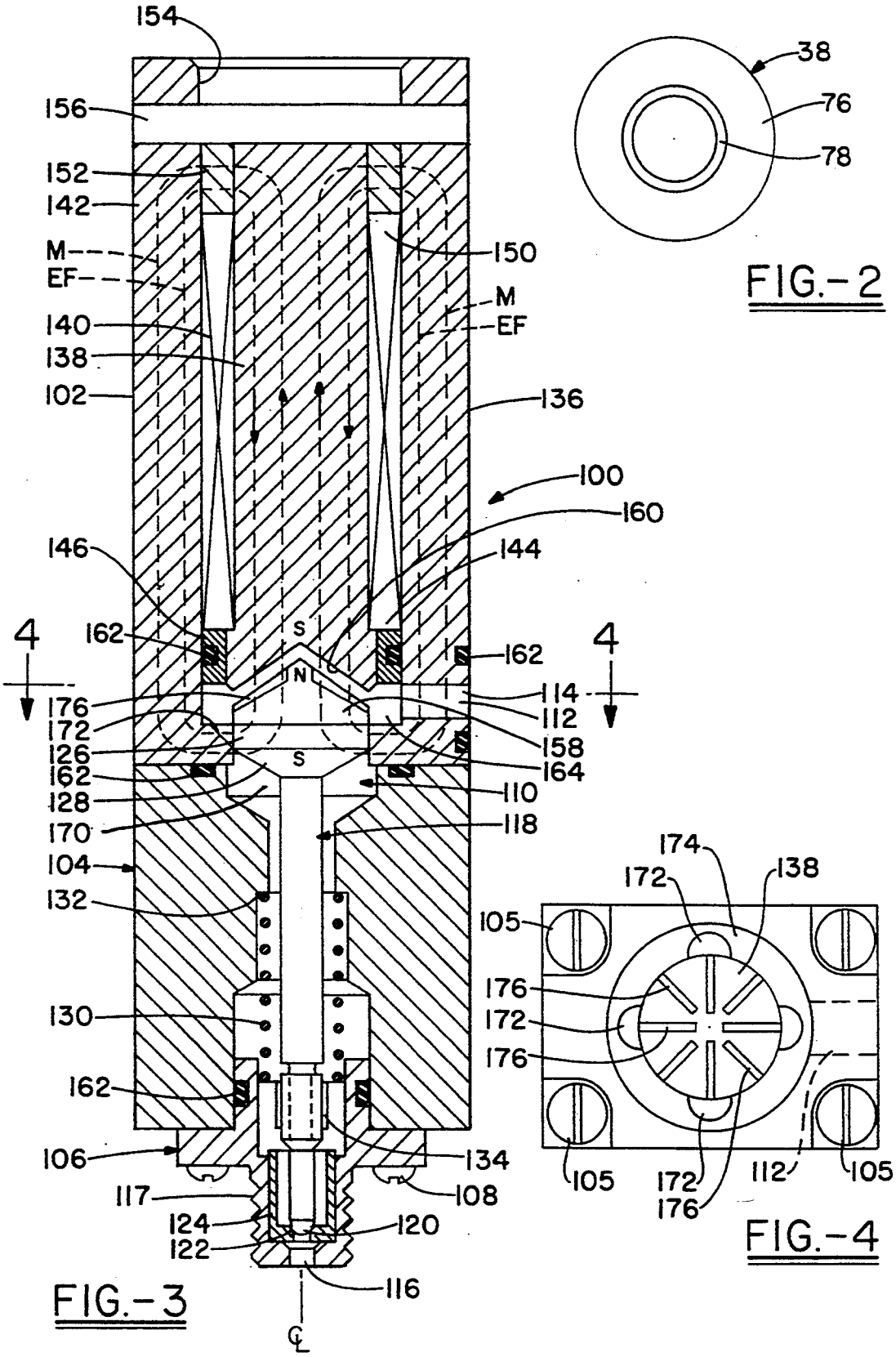
FIG. 2 is a plan view of the permanent magnet taken substantially along line 2—2.
FIG. 3 is a cross-sectional view of a dispenser, according to another embodiment of this invention, wherein the plunger is in the closed position.
FIG. 4 is a plan view taken substantially along line 4—4 of FIG. 3.

Now, with reference to FIGS. 1 and 2, there is illustrated a dispenser, shown generally by reference numeral 10 according to one embodiment of this invention. The dispenser 10 comprises a dispenser body 12, formed with a stepped bore 14, which is coupled through inlet bore 16 to a source of fluid material (not shown), such as a hot melt adhesive. It is preferable that the dispenser body 12 is comprised of a nonferro-magnetic material, such as 300 series stainless steel, or another low magnetic permeable material. and sized such that the flux generated as described further below does not reach the saturation of the material.

The step bore 14 continues from the dispenser body 12 into a bore 20 formed in a seat adapter 22 mounted to the base of the dispenser body 12 by screws 24. The step bore 14 of dispenser body 12 and bore 20 of seat adapter 22 carries a plunger 26 which is slidable mounted for reciprocal motion therein.

The plunger 26 has a valve needle 28, such as a ball, located at one end for mating with a seat 30 of an insert 32, in the closed position. The plunger 26 comprises a magnetic material, such as for example a ferro-magnetic material. The insert aligns the seat within the bore and may include point guide contacts for guiding the valve needle 28 into the seat 30 as the plunger 26 moves to the closed position. The bore 20 of the seat adapter 22 terminates in a discharge outlet 34 for discharging the material from the dispenser 10 when the valve needle is spaced from the seat 30, i.e. in the open position. The outer periphery of the seat adapter 22 may have threads 35 for receiving a nozzle, not shown.

Disposed within the larger bore 36 of the stepped bore 14 is a permanent magnet 38 which is attached to the end 40 of the plunger 26. The permanent magnet may be attached to the plunger by a mechanical fastener, such as a screw, or by means of an adhesive, such as LOCKTITE 640 manufactured by the Locktite Corporation. It is well known that heat can affect the magnetic strength of a permanent magnet. Therefore the choice of a permanent magnet for the dispensing of heated fluids, such as hot melt adhesives, will be more critical than that of dispensing cold glue adhesives. For example, it is not uncommon in the dispensing of hot melt adhesives to experience temperatures in the range from about 149° C. (300° F.) to about 218° C. (425° F.). It is therefore believed, that for applications not exceeding 250° C. (482° F.), that a samarian cobalt, $SMCO_5$, magnet is the preferred permanent magnet.

Disposed between the permanent magnet 38 and the discharge outlet 34 is an electromagnetic coil assembly 42, for generating an electromagnetic field when subjected to a voltage source (not shown). The electromagnetic coil assembly 42 includes a coil 44 comprising a plurality of windings wrapped around a pole piece 46. The pole piece 46 is of a ferro-magnetic material formed in the shape of a hollow tubular member such that the radially inner surface 48 comprises at least a portion of the smaller bore 50 of the stepped bore 14. The windings of the coil 44 are encased in a potting layer 52 and thereafter by bottom 54 and top 56 annular members, each having a hole therein such that the pole piece 46 extends from the radially inner edge 58 of the bottom member 54 to the radially inner edge 60 of the top member 56. A cylindrical member 62 encloses the outer periphery of the coil 44. The pole piece 46 further includes an extended pole portion 64 which extends radially outwardly so that it overlaps a portion of the top annular member 56. It is preferred that the radially outer most portion 66 of the extended pole portion 64 is equal to the radially outer most portion 68 of the permanent magnet 38. The cylindrical member 62 and the bottom annular member 54 are comprised of a ferro-magnetic material, while the top annular member 56 is comprised of a non ferro-magnetic material such as aluminum, brass, or 300 series stainless steel. The use of a non ferro-magnetic material for the top annular member 56 coupled with spacing the radially outermost portion 66 of the extended pole portion 64 from the ferro-magnetic body 12 aids in directing the electromagnetic field generated by the coil to be more effectively utilized in causing the plunger to move or slide within the stepped bore 14. Otherwise, the electromagnetic field would substantially bypass the magnetic field generated by the permanent magnet. A bore 70 is provided to carry the electrical wires 72 from the coil assembly 42 to couple the coil 44 to a source of electrical power (not shown).

In that the bores contain fluid material under pressure, seals are provided at various locations to prevent leakage from, or between, various sealing surfaces.

The operation of the dispenser, according to this embodiment of the invention, will now be described. The permanent magnet 38 has a face 74 which may be, for example, of a constant north polarity (N). This will result in the opposite face 76 having a constant south polarity (S) (obviously the polarities of the magnets could be reversed). Without the electromagnetic coil assembly 42 being energized, the permanent magnet will be attached to the extended pole portion 64 of the pole piece 46. This results in urging the plunger 26 towards the closed position until the valve needle 28 is engaged by the seat 30, thereby preventing the flow of the fluid material from the dispenser. This feature is important to assure that if there is a loss of power, the plunger of the gun will move to the closed position. This eliminates the need of a biasing means, such as a spring, to assure that the gun remains closed do to a loss of power.

To open the gun, a current is passed through the coil of the electromagnetic coil assembly, in such a manner as to set: up a pole of like polarity at the extended pole portion 64 of the pole piece 46 as that of the face 74 of the magnet 38. In other words, if the face 74 of the magnet 38 is a north polarity (N), the coil will be energized to generate an electromagnetic field which induces a north polarity at the extended pole portion 64. The like polarities (north-north) of the magnet and the extended pole portion 64 will repel one another causing the magnet 38 to move away from the extended pole portion 64 which in turn causes the plunger 26 to move with it so that the valve needle 28 is disengaged from the seat 30, thus allowing material to be dispensed through the discharge outlet 34.

Once the plunger has moved to its full open position, the current through the coil, i.e. the power to the coil, may be reduced to a lower hold-in current. In other words, a higher current may be sent to the coil in order to generate a greater electromagnetic field which in turn drives the plunger quickly from the closed to the open position. However, once at the full open position, the amount of current required to maintain the plunger at that position is less, and therefore, a lower amount of current may be supplied. This is especially important due to the fact that more current passing through the coil windings will generate more heat due to the fact that the amount of heat generated is equal to the current squared times the resistance of the wire. Excess heat generated not only affects the efficiency of the operation, but could result in the failure of the coil. It is therefore important to keep the excess heat generated to a minimum. The electrical circuitry for this feature will be discussed in further detail below. While it is important to keep the temperature rise to a minimum with regard to the coil assembly and the permanent magnet, if a hot melt material is to be dispensed, it may be necessary to provide heaters (not shown) at various portions of the dispenser or to an associated service block as is commonly done in order to keep the hot melt flowable. However, the heaters should not overheat the coil or the magnet.

With the dispenser in the open position, the dispenser is closed by reversing the direction of the flow of the current in the coil. This will result in generating a south pole at the extended pole portion 64, which in turn causes the permanent magnet 38 and the plunger 26 to slide within the bore 14 in the direction of the extended pole portion 64 until the valve needle 28 engages the seat 30. Once the plunger has moved to its closed position, the current may be reduced to a lower hold-in value or eliminated entirely if the attraction between the magnet and the extended pole portion is to be solely relied upon as discussed above.

Now, with reference to FIG. 2, there is illustrated the face 76 of the permanent magnet 38. The permanent magnet may be furnished with a raised annular portion 78. The purpose of the annular ring 78 is to reduce the contact area in which the surface 78 of the permanent magnet 38 may come in contact with the end 80 of the stepped bore 14. When in its fully open position, the end 76 of the permanent magnet 38 is juxtaposed to the end 80 of the step bore 14. In that the step bore 14 contains the fluid material, there may develop a surface adhesion between the end 76 and the end 80 which may increase the force necessary in order to cause the plunger 26 to move to the closed position. This phenomenon is similar to interposing a drop of fluid between two pieces of glass and then trying to pull them apart. In order to reduce the effect of this phenomenon, it may be necessary to reduce the contact area between the magnet and the bore 14. The raised ring 78 provides such a reduced surface area, which in turn therefore reduces the surface adhesion force that may exist between the permanent magnet and the wall 80 of the bore. See, for example, U.S. Pat. 4,951,917 to Faulkner, the disclosure thereof is incorporated herein by reference, which describes this in further detail. While the permanent magnet could be integrally formed with this raised ring, a cap could be provided to the face 76 which would perform this function equally as well.

DESCRIPTION OF AN ALTERNATE EMBODIMENT OF THIS INVENTION

Now, with reference to FIGS. 3 and 4, there is illustrated an alternate embodiment, shown generally as reference numeral 100, of the invention. The dispenser 100 may be divided into a first and second body portion 102, 104 joined together by screws 105 and an adapter seat 106 attached to the second body portion 104 by screws 108. The first and second body portions 102,104 and the adapter seat 106 form a stepped bore 110. A fluid channel 112 couples the step bore to an inlet 114 for receiving a flow of fluid material from a fluid source. The stepped bore 110 terminates at a discharge outlet 116 for dispensing the fluid material therefrom. The adapter seat 106 may include threads 117 for receiving a nozzle (not shown).

Slidable mounted for reciprocal movement within the stepped bore 110 is an plunger 118. As in the previous embodiment, the plunger 118 includes a valve needle 120 carried at one end of the plunger for mating with a seat 122 carried in an insert 124 of the adapter seat. A permanent magnet 126 is mounted at the distal end 128 from the needle valve 120 of the plunger. The permanent magnet 126 may be of the same type of materials used for the permanent magnet of the first embodiment.

A spring 130 is mounted within the stepped bore 110 in order to urge the plunger closed such that the valve needle 120 engages the seat 122 to terminate the flow of material. This may be accomplished by allowing the spring 130 to engage a shoulder 132 of the stepped bore 110 while also engaging projections 134 from the plunger 118. The spring must have sufficient force to close the plunger should there be a failure of power.

Mounted within the first body portion 102, and in axial alignment with the plunger 118, is an electromagnetic coil assembly 136. The electro-magnetic coil assembly 136 includes a pole piece 138 in axial alignment with the permanent magnet 126, a coil 140, and a coil casing 142 which also serves as an auxiliary pole piece. The pole piece 138 and the coil casing 142 are each comprised of a magnetic material such as a solenoid quality stainless steel having a small compressed hysteresis curve.

The coil 140 comprises a plurality of windings wrapped around the pole piece 138. The outer periphery of the coil 140 is enclosed by the auxiliary pole piece 142. The axial end 144, of the coil 140 closest to the permanent magnet 126 is enclosed by a non-magnetic ring spacer 146. The ring spacer may be comprised, for example, of a 300 series stainless steel or other similar material. The spacer is non-magnetic in order to drive the electromagnetic flux generated by the electro-magnetic coil assembly 136 through the plunger as will be discussed in further detail below. The axial end 150 of the coil 140 is enclosed by a magnetic ring spacer 152 of a ferro-magnetic material for directing magnetic fields from between the pole piece 138 and the auxiliary pole piece 142. The coil 140 and the pole piece 138 is disposed within a bore 154 of the coil casing 142 and is held in place therein by a rod (not shown) perpendicular to the centerline CL of the dispenser 100 in a bore 156.

In order to increase the holding force between the permanent magnet and the pole piece, a cap 158 of magnetic material, such as a ferro-magnetic material, may be attached to the permanent magnet 126. The cap 158 may have a surface formed in a geometric arrangement such that the effective surface area is increased. In this particular embodiment, the cap is generally frustoconical. In like manner, the pole piece 138 is formed with a surface at the end 160 closest to the permanent magnet which mates with the cap 158 of the permanent magnet 126. Alternatively, the magnet and the cap may be all one piece.

In that the stepped bore 110 contains fluid material under pressure, seals 162 are provided at various locations to prevent the material from leaking from, or between, the various sealing surfaces.

The adhesive enters the dispenser via the bore 112 and flows into the cavity 164 of the step bore 110. The material flows past the permanent magnet through channels 172 and into cavity 170 of the step bore 110 before finally exiting through the discharge outlet 116.

With the electromagnetic coil assembly 136 in the deenergized state, the spring 130 biases the plunger 118 in the closed position to prevent the material flowing from the discharge outlet 116. As in the previous embodiment, the permanent magnet has a constant polarity wherein the cap 158 may have, for example, a north polarity while the end of the plunger 128 in contact with the permanent magnet 126 will have an opposite (south) polarity.

To cause the dispenser 100 to dispense fluid material, a current is passed through the coil 140 of the electromagnetic coil assembly 136 in such a manner as to induce a pole of opposite polarity at the end 160 of the pole piece 138 to that of the cap 158. In other words, if the permanent magnet was oriented such that the cap 158 has a north polarity, the end 160 of the pole piece 138 will be induced with a south polarity. The electromagnetic field EM generated by the coil of the electromagnetic coil assembly 136 and the magnetic field M generated by the magnet will flow through the pole piece, the magnetic ring spacer 152 and the coil casing 142 substantially as indicated. The coil casing is provided with a generally, inwardly, extending pole portion 174. This pole portion 174 will have a polarity which is opposite to that generated in the end 162 of the pole piece 138. The cap 158 and the pole piece 138, having opposite polarities, will be attracted to one another. This will cause the plunger 118 to slide axially toward the pole piece 138. This will cause the valve needle 120 to lift off of the seat 122, which in turn allows for the fluid material to pass through the dispenser and to be discharged from the discharge opening 116.

To close the dispenser, the direction of flow of the current in the coil 140 is reversed such that the electromagnetic field EM generated induces a like polarity at the end 160 of the pole piece 138 as that of the cap 158. In other words, the direction of the flow of the electromagnetic field will be reversed. Therefore, in this example, the end 160 will be impressed with a north polarity such that the cap and the pole piece would repel one another. The force generated by the interaction of the electromagnetic coil and the magnetic field M, coupled with the spring biasing, will cause the plunger 118 to slide axially to the closed position such that the valve needle 120 engages the seat 122.

As before, once the plunger has moved to its full open or full closed position, the amount of current driving the coil of the electromagnetic coil assembly may be reduced to a lower level or removed completely.

A means to reduce the surface adhesion between the cap 158 and the end 160 of the pole piece 138 may also be used. However, instead of annular rings, it is believed to be more preferred in this embodiment, to use spaced apart ridges 176 extending from the vicinity of the center of the cap to its outer edge.

As set forth above, it may be desirous to reduce the driving current to the solenoid to a lower, hold in level. U.S. Pat. No. 4,453,652 (Controlled Current Solenoid Driver Circuit), disclosure of which is incorporated herein by reference, and assigned to the assignee of this invention, describes a method of reducing the current flow through a coil once the plunger has moved to its open position. The circuitry disclosed therein is for the control of a solenoid which does not reverse its field. As such, this circuitry could be duplicated for each direction of current flow in the coil for use with the first embodiment of the invention. A means could then be provided for transferring from one circuit to another, thus allowing the plunger to be driven in both directions. Other current driving schemes could be used that would also reduce the power consumption of the coil.

While certain representative embodiments and details have been shown for the purpose of illustrated the invention, it will be apparent to those skilled in the art that various changes and modifications may be made therein without departing from the scope of the invention.

For example, while it is preferable to eliminate the need for dynamic seals, it would be possible to extend the plunger in either embodiment through a dynamic seal in order to isolate the magnet of the plunger from the fluid material. This would help isolate the magnet from the heated fluid, which may in turn reduce the transfer of heat to the magnet.

Also, with regard to the alternate embodiment of the invention, instead of the windings of the coil 140 being wrapped directly about the pole 138 they could be wrapped about a spool or bobbin with the pole 138 extending through the center of the spool. Also, in order to further reduce the heat transfer to the coil from the heated fluid, an insulator may be placed between the coil and the spacer 146. The insulator could be fiberglass, for example, or an air gap may be formed between the axial end 144 of the coil and the spacer 146.

Still further, it may be beneficial to dissipate heat from the coils 44,140 by coupling them to a heat sink. For example, the housing 12 and the case housing piece 142 may be equipped with fins to radiate excess heat away from the coils.

It is claimed:

1. An apparatus for dispensing a polymeric material comprising:

a housing having a bore, coupled to an inlet for receiving said material, said bore having a discharge outlet for dispensing said material;

a plunger slidably mounted in the bore for reciprocally moving from an open to a closed position, having a valve needle carried at a first end for mating with a seat in the closed position to prevent the discharge of material from the discharge outlet and being spaced a predetermined distance therefrom in the open position to permit the discharge of material from the discharge outlet;

a magnet, carried at a second end of the plunger;

an electromagnetic coil assembly, having a pole piece and a coil having a plurality of windings disposed around said pole piece, for generating an electromagnetic field; and wherein the interaction of the electromagnetic field and a magnetic field generated by said magnet effects the slidable movement of the plunger within the bore.

2. The apparatus of claim 1 wherein the pole piece defines at least a portion of said bore.

3. The apparatus of claim 2 wherein the electromagnetic coil assembly includes a means for directing the electromagnetic field to interact with the magnetic field of the magnet.

4. The apparatus of claim 1 wherein the pole piece of the electromagnetic coil assembly is in axial alignment with the magnet.

5. The apparatus of claim 3 wherein the coil of the electromagnetic coil assembly is disposed between first and second end pieces, each having an aperture therein, and an outer ring extending from the first to the second end piece, to encompass an outer periphery of the coil, and wherein the pole piece extends from the aperture of the first end piece to the aperture of the second end piece to enclose an inner periphery of the coil.

6. The apparatus of claim 5 wherein the first end piece is non-ferromagnetic and is disposed closer to permanent magnet than the second end piece for directing the electromagnetic field to interact with the magnetic field of the permanent magnet.

7. The apparatus of claim 5 wherein the pole piece has an extended pole portion disposed between at least a portion of the first end piece and the permanent magnet.

8. The apparatus of claim 1 wherein the electromagnetic coil assembly is disposed between the permanent magnet and the discharge outlet.

9. The apparatus of claim 1 wherein the bore is a stepped bore, one of the stepped bores having the permanent magnet disposed therein and being connected to the inlet by a passageway.

10. The apparatus of claim 9 wherein the magnet contains means to reduce surface adhesion between the magnet and a wall of the stepped bore.

11. The apparatus of claim 1 wherein the permanent magnet is disposed between the electromagnetic coil assembly and the discharge opening.

12. The apparatus of claim 11 further comprising an auxiliary pole piece located axially outwardly of the electromagnetic coil assembly for providing flux paths and having an axially inwardly extending portion in fluid contact with the material and disposed adjacent to the permanent magnet.

13. The apparatus of claim 12 wherein the plunger further includes a ferro-magnetic cap means attached to the permanent magnetic and disposed between the permanent magnet and the pole piece.

14. The apparatus of claim 13 wherein the inwardly extending pole section of the auxiliary pole piece is located 90°, in cross-section, from the pole piece and wherein, the inwardly extending pole sections will have an opposite plurality to that of the pole piece adjacent to the permanent magnet when the axially pole piece is subjected to the flux generated by the coil.

15. The apparatus of claim 14 further comprising a biasing means for urging the needle toward the seat.

16. The apparatus of claim 15 wherein the permanent magnet contains means to reduce surface adhesion.

17. The apparatus of claim 11 further comprising a means for increasing the attraction forces between the plunger and the pole piece when said plunger and said pole piece are juxtaposed.

18. An apparatus for dispensing polymeric materials comprising:

a housing having a bore therein, the bore being coupled to an inlet for receiving said material and to a discharge outlet for dispensing said material therefrom;

a means, movably mounted within the bore, including a mating means for mating with a seat in a closed position to prevent the discharge of material from the discharge outlet, and being spaced therefrom in an open position;

a magnet for generating a magnetic field;

a means for generating first and second electromagnetic fields of opposite polarity; and a means for directing said magnetic field, and one of first and second said electromagnetic fields to co-operate with each other to effectuate the movement of the means, movably mounted within the bore, from the open to the closed position and/or from the closed to the open position.

19. The apparatus of claim 18 wherein the magnet is carried by said means movably mounted within the bore; and the means for generating electromagnetic fields includes a coil.

20. The method of dispensing a polymeric material comprising the steps of:

directing the flow of the polymeric material through a bore containing a plunger slidably mounted therein, said plunger including a magnet for generating a magnetic field;

generating an electromagnetic field;

causing the generated electromagnetic field and the magnetic field to co-operate with one another to effectuate the movement of the plunger from a closed to an open position; and wherein the polymeric material is directed past said plunger and discharged from a discharge orifice.

21. The method of claim 20 further comprising the steps of:

reversing the polarity of said electromagnetic field; and causing said magnetic and electromagnetic fields to cooperate with one another to effectuate the movement of the plunger to the closed position, wherein the flow of the polymeric material from the discharge orifice is prevented.

22. The method of claim 21 wherein the step of generating said electromagnetic field includes passing a first current through a coil and wherein the step of reversing the polarity of said electromagnetic field includes passing a second current through said coil in a direction opposite that of the first current flow.

23. The method of claim 20 wherein the step of generating an electromagnetic field is generated by an electro-magnetic coil assembly having a pole face in proximity to a pole face of the magnet and includes inducing a like polarity at said pole face as that of the pole face of the magnet.

24. The method of claim 20 further comprising the step of:

a) de-energizing the electro-magnetic field; and b) causing the plunger to move from the open to the closed position due to the magnetic field of the magnet.

25. An apparatus for dispensing a polymeric material comprising:

a housing having a bore;

a plunger slidably mounted in the bore for reciprocally moving from an open to a closed position, having a means carried at a first end for mating with a seat in the closed position to prevent the discharge of material from a discharge outlet and being spaced a distance therefrom in the open position to permit the discharge of material from the discharge outlet;

a magnet, carried at a second end of the plunger;

an electromagnetic coil assembly, having a pole piece and a coil having a plurality of windings disposed around said pole piece, for generating an electromagnetic field; and wherein the interaction of the electromagnetic field and a magnetic field generated by said magnet causes the movement of the plunger within the bore.

* * * * *